US010465313B2

(12) United States Patent
Beckers et al.

(10) Patent No.: US 10,465,313 B2
(45) Date of Patent: Nov. 5, 2019

(54) DEVICE FOR THE THERMAL TREATMENT OF YARNS

(71) Applicant: Saurer Technologies GmbH & Co. KG, Krefeld (DE)

(72) Inventors: Joachim Beckers, Mönchengladbach (DE); Siegfried Brenk, Krefeld (DE); Michael Deitlaff, Krefeld (DE); Sergei Singer, Krefeld (DE); Jörg Zischewski, Willich (DE)

(73) Assignee: Saurer Technologies GmbH & Co. KG, Krefeld (DE)

( * ) Notice: Subject to any disclaimer, the term of this patent is extended or adjusted under 35 U.S.C. 154(b) by 50 days.

(21) Appl. No.: 14/809,370

(22) Filed: Jul. 27, 2015

(65) Prior Publication Data

US 2016/0040324 A1 Feb. 11, 2016

(30) Foreign Application Priority Data

Aug. 7, 2014 (DE) ..... 10 2014 011 696

(51) Int. Cl.
*D02J 13/00* (2006.01)
*D06B 23/00* (2006.01)
(Continued)

(52) U.S. Cl.
CPC ..... *D02J 13/00* (2013.01); *D06B 23/00* (2013.01); *D06B 23/18* (2013.01); *D06C 15/06* (2013.01);
(Continued)

(58) Field of Classification Search
CPC . D06C 15/06; D02J 3/003; D02J 13/00; D02J 15/06; D06B 23/18; D06B 23/00
(Continued)

(56) References Cited

U.S. PATENT DOCUMENTS 3,067,602 A * 12/1962 Brunt ..... D06B 23/16 68/180
3,084,448 A * 4/1963 Dungler ..... D06B 3/20 159/DIG. 15
(Continued)

FOREIGN PATENT DOCUMENTS

DE 3418942 A1 11/1985
DE 39 38 183 A1 5/1991
(Continued)

OTHER PUBLICATIONS

The Textile Institute. Advances in Yarn Spinning Technology. Woodhead Publishing, 2010, p. 390.*
(Continued)

*Primary Examiner* — Joseph L. Perrin
*Assistant Examiner* — Kevin G Lee
(74) *Attorney, Agent, or Firm* — Nelson Mullins Riley & Scarborough LLP

(57) ABSTRACT

A device for the thermal treatment of yarns comprising at least one inlet opening and at least one outlet opening for at least one transport means, which transports the yarn through the device, and comprising separating elements at the inlet opening and the outlet opening for thermal shielding, in order to minimise the exchange of media to the environment. The separating elements are configured to have a low bending rigidity and are arranged such that a surface load is applied onto the yarn lying on the transport means, for example a conveyor belt, which is not greater than 0.005 kg*cm$^{-2}$.

6 Claims, 4 Drawing Sheets

(51) Int. Cl.

| | |
|---|---|
| ***D06C 15/06*** | (2006.01) |
| ***D06B 23/18*** | (2006.01) |
| *D06B 17/00* | (2006.01) |
| *D06B 23/16* | (2006.01) |

(52) U.S. Cl.
CPC ..... *D02J 13/001* (2013.01); *D06B 17/005* (2013.01); *D06B 23/16* (2013.01)

(58) Field of Classification Search
USPC ..... 57/2.3
See application file for complete search history.

(56) References Cited

U.S. PATENT DOCUMENTS

| | | | | | |
|---|---|---|---|---|---|
| 3,371,509 | A * | 3/1968 | Dungler | D06B 19/0035 | 34/242 |
| 3,927,540 | A * | 12/1975 | Tanaka | D06B 23/16 | 277/432 |
| 3,939,576 | A * | 2/1976 | Lawrence | D06B 23/16 | 26/18.5 |
| 4,718,257 | A * | 1/1988 | Reinehr | D06C 7/00 | 68/5 D |
| 4,742,797 | A * | 5/1988 | Barker | G03G 15/0898 | 118/50 |
| 4,949,558 | A | 8/1990 | Enderlin | | |
| 5,014,380 | A | 5/1991 | Enderlin | | |
| 5,189,810 | A | 3/1993 | Vetter | | |
| 5,638,610 | A | 6/1997 | Resch | | |
| 6,228,220 | B1 * | 5/2001 | Hada | D21F 1/48 | 162/203 |
| 2002/0060018 | A1 * | 5/2002 | Lindsay | D21F 1/48 | 162/198 |
| 2009/0188772 | A1 | 7/2009 | Massotte et al. | | |

FOREIGN PATENT DOCUMENTS

| | | |
|---|---|---|
| DE | 195 16 127 A1 | 11/1996 |
| EP | 1 055 763 A2 | 11/2000 |
| EP | 1 325 974 A2 | 7/2003 |
| EP | 2 221 404 A2 | 8/2010 |
| GB | 1 295 353 | 11/1972 |
| GB | 2 092 191 A | 8/1982 |

OTHER PUBLICATIONS

European Search Report for corresponding European Patent Application No. 15002123.6 dated Jan. 5, 2016; all enclosed pages cited.

* cited by examiner

DEVICE FOR THE THERMAL TREATMENT OF YARNS

CROSS-REFERENCE TO RELATED APPLICATIONS

This application claims priority from German National Patent Application No. 10 2014 011 696.4, filed Aug. 7, 2014, entitled "Vorrichtung zur thermischen Behandlung von Garnen", the entire contents of which are incorporated herein by reference.

FIELD OF THE INVENTION

The invention relates to a device for the thermal treatment of yarns comprising at least one inlet opening and at least one outlet opening for at least one transport means, which transports the yarn through the device, and comprising separating elements at the inlet opening and the outlet opening for thermal shielding, in order to minimise the exchange of media to the environment.

BACKGROUND OF THE INVENTION

To ensure that textiles fulfill their purpose and have the desired properties in terms of feel, appearance and behaviour when in use, they are processed specifically. In addition to the extraction of fibers, the production of yarns and threads and formation of surface properties there are further methods which influence the textile properties.

Depending on the intended purpose it may be necessary for the textile to have greater stability, greater volume in the thread-like product or increased temperature resistance, to give but a few examples.

Many of these methods require subsequent thermal fixing which is usually performed using superheated steam under atmospheric pressure or pressurised saturated steam, in order to permanently stabilise the desired properties. Usually, the fixing process is referred to in the textile industry as heat setting, in the field of carpet yarn production the synonym heatset process is used.

In the field of carpet yarn production for example there are straight set yarns and frieze yarns. Whereas with a straight set yarn the straight linear structure of the single yarns or the cabled yarns or threads is heat set, in the case of frieze yarns after the cabling process the yarn is shaped three-dimensionally by bending/compressing and this state is then made permanent by thermal treatment. In addition, the thermal treatment causes a shrink billowing of the thread which increases the volume of the thread.

The term thread is defined in terms of this application to mean all linear forms. These can include yarns, threads but also film tapes and looped and ribbon-like textiles and the like. The term thread is used synonymously in all of the possible alternatives in this application for reasons of simplification.

German Patent Publication DE 39 38 183 A1 discloses a device for the continuous thermal treatment of yarns. To improve the sealing of the device at the inlet and outlet opening an inlet pre-zone is arranged upstream and an outlet pre-zone is arranged downstream. So-called yarn climate barriers are also integrated into the pre-zone which deflect the steam inside the device so that superheated steam is prevented from escaping. The counterflow principle is also intended to create a specific seal, so that no cold air can flow from the outside into the actual fixing chamber. In addition, in the region of the inlet opening narrow plates are also arranged which also make it more difficult for cold external air to enter.

In German Patent Publication DE 195 16 127 B4 a treatment chamber is also described for the continuous thermal treatment of yarns. In the area of the inlet and outlet opening so-called ventilation barriers are provided which are used for sealing the treatment chamber from the surrounding air. Here a counterflow is produced by means of fans which is guided vertically upwards and suctioned away.

By means of European Patent Publication EP 1 055 763 A2 a method and a device are known for continuously treatment a length of material with steam for fixing. Here before the inlet or outlet opening an inlet or outlet control is arranged with a suction device. Furthermore, by means of intermediate plates both controls are designed so that there is only a gap for the length of material and possibly a conveyor belt.

In US Published Patent Application 2009/0188772 A1 an additional, alternative machine is described for the thermal treatment of yarns. Said machine comprises a sealing head at the inlet and outlet opening, which comprises two rollers which press against opposite surfaces of the conveyor belt.

A further variant of a yarn finishing system is disclosed in European Patent Publication EP 2 221 404 A2. To prevent steam escaping from the treatment chamber the openings for transporting the yarn in and out are closed as far as possible by a steam barrier. Said steam barrier contains a rotatable roller which lies on the yarn lying on the conveyor belt, as well as a sheet metal screen which closes the opening as far as possible and so-called sealing lips which are arranged on the lower side of the tractive strand and on the upper and lower side of the loose strand. The roller can have different surface shapes and if necessary can be opened by a mechanism, in case of material blockage or for cleaning.

The disadvantage of devices which clamp the thread between one or two rollers and the conveyor belt has proved to be that at the points where the placed threads cross over one another, pressure points are created over the length of a yarn diameter which are also fixed. Said pressure points affect the uniformity of the yarn as in this area the compression is greater, which for example during dyeing and during later surface finishing results in an uneven product. In the final product of the textile surface said points are then slightly lighter because of their different light reflective behaviour. This occurs when threads are placed on a conveyor belt. According to the belt speed in practice the density is relatively high and several centimeters thick, so that the threads are frequently forced to cross over one another. The conveyor belt with the threads lying thereon runs through the gore of the squeezing roller pairs or the rollers on the conveyor belt, and this has a negative effect particularly at the outlet opening, through which the recently heated threads run through the output roller(s) into the cooler atmosphere. Mainly if the threads have not yet been cooled completely said deformations remain in permanent form and are fixed permanently during the subsequent cooling. Furthermore, it can cause the flattening of the threads.

Furthermore, with slit screens and differently designed narrow outlets there is a risk that the threads can accumulate at the upper edge. In particular, with a high density of threads and the associated high occupancy density there are displacements, accumulations and reorientations of the upper thread layers. This can lead to catching during the subsequent removal of the threads from the conveyor belt. Furthermore, the fiber materials can be damaged by friction on the sealing parts.

In addition, yarn climate barriers, ventilation barriers and the like are not only structurally expensive and increase the costs of a device for thermal treatment, but also the use/operation of such devices is expensive.

SUMMARY OF THE INVENTION

The underlying objective of the invention is to propose an improved device for the thermal treatment of yarns.

Such objective is addressed in a device for the thermal treatment of yarns comprising at least one inlet opening and at least one outlet opening for at least one transport means, which transports the yarn through the device, and comprising separating elements at the inlet opening and the outlet opening for thermal shielding in order to minimise the exchange of media to the environment. According to the invention, the separating elements are arranged and configured with a low bending rigidity so that a surface load is applied to the yarn lying on the transport means, for example a conveyor belt, which is not greater than 0.005 $kg*cm^{-2}$. Advantageous embodiments of the invention are more fully described herein.

As on the thermal treatment device the separating elements according to the invention are attached to the inlet and outlet opening, on the one hand the steam area is still shielded sufficiently, and on the other hand the surface load is such that it only exerts a low mechanical load on the threads deposited on the transport means. The mechanical load has to be so low that even at a thickness of several centimeters no pressure points are formed on the crossing thread layers which later have a negative effect on the end product. Instead of (squeezing) rollers gently contacting shielding elements are used. This has a positive effect on the quality of the processed thread.

A further advantage is that the inlet and outlet openings no longer need to be protected by slit screens or the like from losing too much energy. In the embodiment according to the invention a high occupancy density no longer leads to displacements, accumulations and reorientations of the upper thread layers as there are no longer any fixed edges. The separating elements do not noticeably compress the crossing thread layers on the transport means. This is has a positive effect when removing the threads from the transport means, there are fewer catches and the threads can be wound more easily so that there are fewer stoppages in the production overall.

Advantageously it is possible, in certain circumstances, for example to improve threading, to lift the separating elements upwards by means of suitable devices, for example pneumatic cylinders or motor-drives.

The solution according to the invention can also be achieved more simply in terms of structure and less expensively than the devices according to the prior art. The separating elements can be integrated easily into a device for thermal treatment. It is also possible to retrofit devices for thermal treatment which are already in use.

As a secondary effect for improving the quality of the thermally treated threads by means of the solution according to the invention lastly also the effectiveness of the system is increased because the escape of steam is restricted and thus also less fresh steam has to be supplied.

Preferably, the separating elements for thermal shielding are made from a flexible material arranged on the side of the transport means covered with yarn to minimise the exchange of media.

The flexible material is defined in this application to mean all flexible surface forms. The latter can be woven fabric, knitted or crocheted fabric, films, paper, felt, fleece materials, composite materials, steel and the like. For simplification the flexible material is used as a synonym for the possible alternatives within the scope of this application.

This variant has the advantage that individual flexible materials, preferably the width of the transport means, are fixed to an end side in a holding piece and lie with the free end loosely on the threads. Preferably, a curve is formed in the flexible material or the flexible material already has a curved form so that the separating element lies flat on the free end flat on the thread/threads. The load on the threads is determined essentially by the inherent weight, the bending rigidity, the length and the bearing angle of the flexible material used.

Furthermore, the separating element is designed as a flexible loop.

In this way the area of the element lying on the threads can be increased. In this way the shielding of the fixing zone is improved without the known disadvantages from the prior art.

According to another aspect of the invention, a loading element is arranged inside the loop.

If necessary it is also possible to weigh down an element for shielding without expensive modifications and if necessary for a short period. This may be practical for example if the thickness of the arrangement of threads on the transport means is lower or if particularly durable materials are being processed. By means of the weight of the loading element a greater surface load is exerted on the threads lying on the transport means.

The loading element inside the loop can be formed by a cylinder or the like. It is also possible within the scope of the invention that an additional element is arranged inside the loop, depending on which surface load is to be applied by the loading element.

It is particularly advantageous that the yarn-contacting side of the flexible material has low friction properties.

This advantageous configuration ensures that the threads lying on the transport means have an extremely gentle contact with the separating element and the fiber materials are not damaged by excessive friction. Furthermore, low friction surfaces generally have good resistance to abrasion.

In a further advantageous embodiment, the separating elements for thermal shielding are designed as a movable flap to minimise the exchange of media.

It is also possible within the scope of the invention that movable flaps or vanes can be designed as the separating elements which are mounted to be free and easily pivotable in the upper holder. Here too the weight of the materials used can influence the degree of surface load exerted on the threads lying on the transport means.

In two further variants, the separating elements are designed respectively as a rotatable roller or upper band for thermal shielding to minimise the exchange of media, the surface of the upper band being made for example from an easily compressed material such as foam. Both the rotatable roller and the upper band can be driven or also passively dragged along.

The yarn-contacting surface is increased in this way and a higher degree of sealing is achieved. By means of the flexibility of the foam the thread layers can run through the gore without damage.

According to another feature of the invention, at least two separating elements are provided which are arranged one behind the other.

By means of this alternative configuration, as appropriate depending on the material used and the type of thread produced, such as for example compressed or straight threads, the device for thermal treatment can be screened even more effectively. Within the scope of this invention it is also possible to combine different alternatives with one another, for example a film as a first separating element, followed by two separating elements made of film in the form of loops, the last loop being weighed down by a loading element in material flow direction. It would also be possible for example for the separating elements arranged one behind the other to have increasing bending rigidity. In cascaded solutions the clamping levels of the individual separating films needs to be different.

In a further advantageous embodiment, the separating elements are designed to be lamellar at least in the region of the free ends.

The separating elements, such as for example films, fabrics or flaps, can be slit at least once. In this way differences in the density of the threads on the transport means can be evened out.

According another aspect of the invention, the separating elements can be used in a multipoint installation, in particular for twisting and cabling machines.

This constellation is advantageous because in this way the threads can be continually processed and fixed. The invention is explained in more detail in the following with reference to an example embodiment shown in the drawings.

DETAILED DESCRIPTION OF THE INVENTION

Figure 1A:
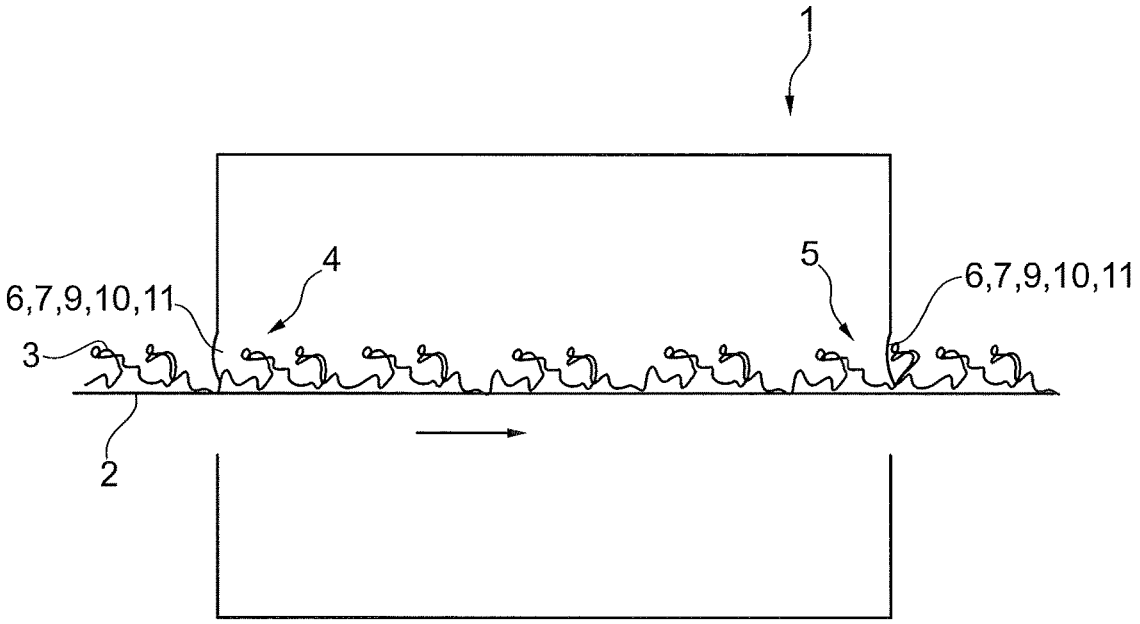
FIG. 1*a* shows a schematic representation of a device for the thermal treatment of yarns.

FIG. 1*a* shows schematically and in a much simplified form a device 1 for the thermal treatment of yarns 3.

Once the threads 3 have passed through a (not shown) shaping device and have been bent and/or crushed (crimped) three-dimensionally in a geometrically irregular manner, the thread mass lies on the transport means 2.

Figure 1B:
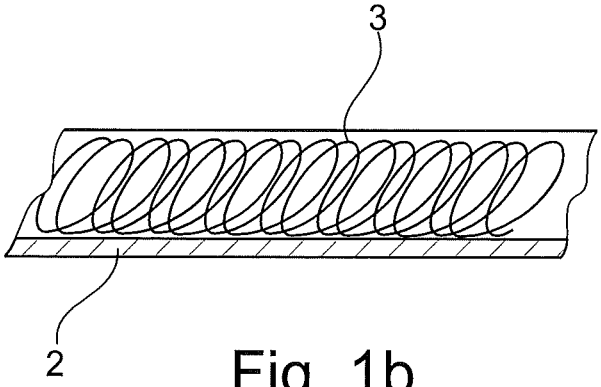
FIG. 1*b* shows an example of a yarn deposit on a transport means.
Figure 1C:
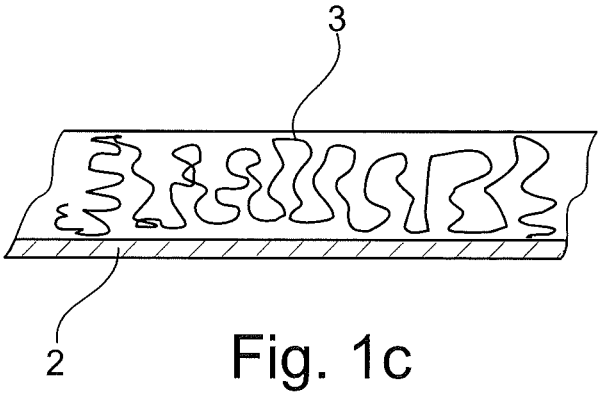
FIG. 1*c* shows a further example of a yarn deposit on a transport means.

Of course, it is also possible within the scope of this application that the threads 3 are deposited linearly or in any other form on the transport means 2. FIG. 1*b* shows the depositing of yarn for so-called straight set threads, i.e. threads that are referred to as uncrimped threads disregarding the bending radii. FIG. 1*c* shows the deposit of frieze yarns which have a three-dimensional shape.

Lying on the transport means 2 the threads 3 first of all run through the inlet opening 4 and then the outlet opening 5 of the device 1 for thermal treatment which is operated by steam.

The heating is performed there up to the so-called heat-setting temperature or bulk temperature. This is usually achieved in practice by saturated steam or superheated steam. In this way the threads experience a material-determined shrinking and bulking.

This means that the threads 3 enter the device 1 in a deformed state and leave the device 1 in a deformed and permanently fixed state.

Figure 2:
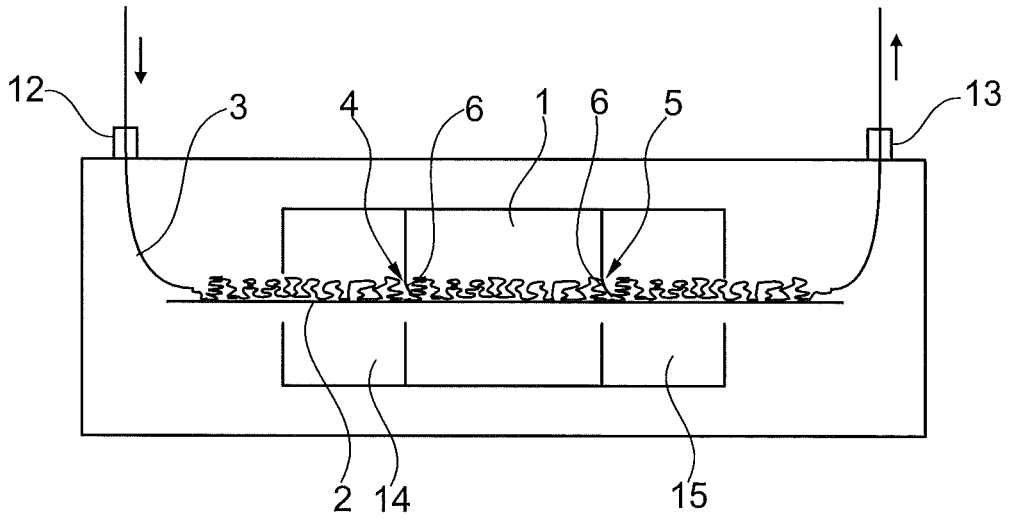
FIG. 2 shows a schematic representation of an alternative device for the thermal treatment of yarns.

FIG. 2 shows a device 1 for thermal treatment which is integrated into a closed system which threads enter untreated and leave in a shaped and fixed state.

In addition, threads 3 are transported by an input control 12 into the closed system and supplied to a shaping device 14. Here the threads 3 are crimped and then enter the steam zone of a device 1 for thermal treatment. They are then heated to the thermosetting-temperature. Lastly, the threads 3 enter the following cooling zone 15, in which they are cooled below their material-specific glass transition temperature, so that the present state is permanently stabilised or fixed.

The closed system has the particular feature that the pressure therein differs from the atmosphere. Therefore, the whole pressure chamber is sealed from the environment at the thread input and thread output by input and output controls which prevent the equalisation of pressure with the environment. However, as the three treatment areas, shaping device 14, device 1 and cooling zone 15 do not differ from one another in their pressure levels, the temperature shielding is achieved by a flexible material 6, in this case a coated fabric.

Figure 3:
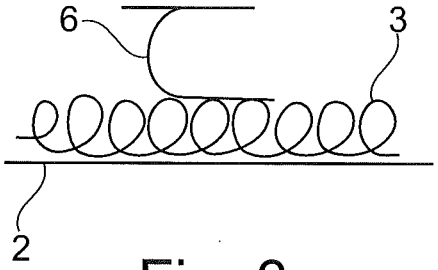
FIG. 3 shows a schematic representation of alternative separating elements according to the invention.

FIG. 3 shows an embodiment of the flexible material 6. With a straight set yarn the straight linear structure of the deposited threads has to be fixed. Owing to its bending rigidity the film with the continuous threads 3 arches in material flow direction. Although the film lies on the threads 3 it does not compress the threads 3 essentially.

Figure 4:
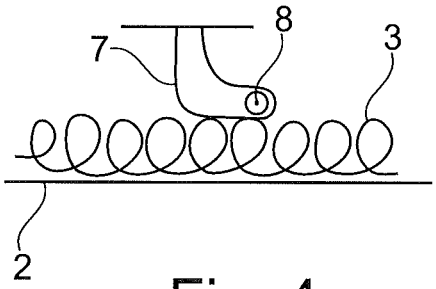
FIG. 4 shows a schematic representation of alternative separating elements according to the invention.

FIG. 4 shows the variant in which the flexible material is in the form of a flexible loop 7 which is also weighed down by a cylinder 8.

Figure 5:
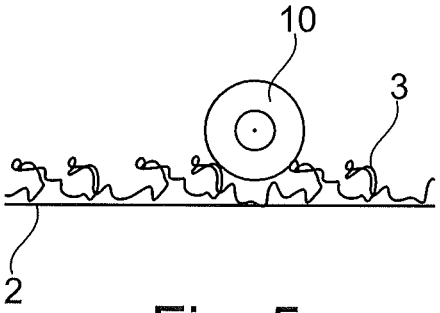
FIG. 5 shows a schematic representation of alternative separating elements according to the invention.

FIG. 5 illustrates the alternative of the foam-covered roller 10. As the foam is an easily compressed material, a contacting placement of the foam roller 10 does not crush the cross thread layers.

Figure 6:
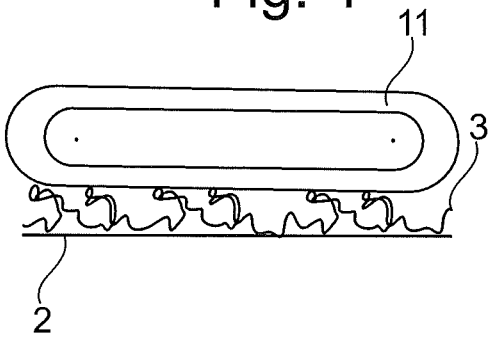
FIG. 6 shows a schematic representation of alternative separating elements according to the invention.

FIG. 6 shows a foam-covered upper band 11 instead of the foam-covered roller 10.

Figure 7:
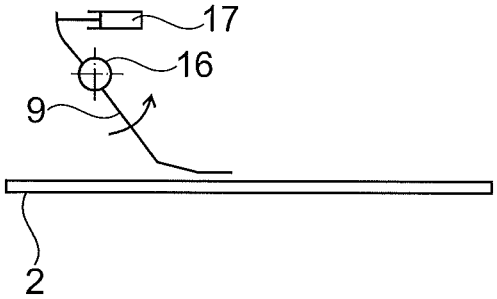
FIG. 7 shows a schematic representation of alternative separating elements according to the invention.

FIG. 7 shows an alternative embodiment of the movable flap 9. The flap 9 is mounted movably on the point of rotation 16 and can be lifted upwards to facilitate the threading of the threads by means of a pneumatic cylinder 17.

Figure 8:
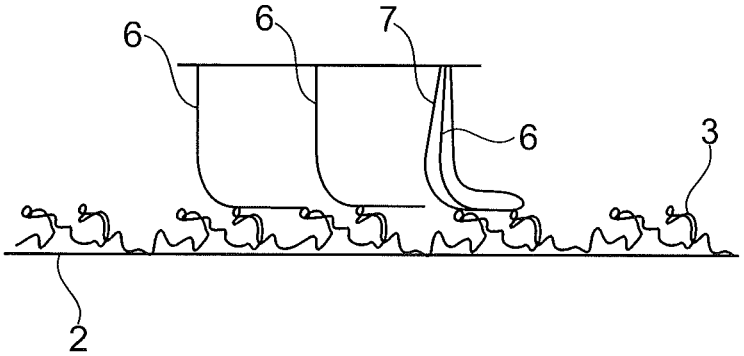
FIG. 8 shows a schematic representation of alternative separating elements according to the invention.

FIG. 8 shows a combination of a plurality of separating elements arranged behind one another. In order to shield the device 1 from the environment, firstly two flexible materials 6 are provided, followed by a loop 7, in which an additional flexible material 6 is arranged.

The present invention has been herein described in relation to an exemplary embodiment or embodiments for purposes of providing an enabling disclosure of the invention. However, it will be understood by persons skilled in the relevant art that the present invention is susceptible of a broader utility and application. Accordingly, it is to be expressly understood that the present invention is not to be construed as limited to the embodiments, features and aspects herein described, but only according to the appended claims.

What is claimed is:

1. Device (1) for the thermal treatment of yarns (3) comprising at least one inlet opening (4) and at least one outlet opening (5) for at least one transport means (2), which transports the yarn (3) through the device (1), and comprising separating elements at the inlet opening (4) and the outlet opening (5) for thermal shielding in order to minimise the exchange of media to the environment, in which the separating elements are arranged on the side of the transport means (2) covered with yarn (3), characterised in that the separating elements are disposed only on the side of the transport means (2) covered by the yarn and out of contact with the transport means (2) to passively follow in contact with and yield to the yarns (3), the separating elements comprise a flexible loop (7) wherein a loading element (8) is a weight arranged inside the flexible loop (7), and said separating elements having a predetermined bending rigidity to apply a predetermined surface load onto the yarn (3) lying on the transport means (2) less than 0.005 $kg*cm^{-2}$ selected to effectively maintain uniformity of thermal treatment of the yarn (3) within the device (1) without causing damage to the yarn (3).

2. Device (1) for the thermal treatment of yarns (3) comprising at least one inlet opening (4) and at least one outlet opening (5) for at least one transport means (2), which transports the yarn (3) through the device (1), and comprising separating elements at the inlet opening (4) and the outlet opening (5) for thermal shielding in order to minimise the exchange of media to the environment, in which the separating elements are arranged on the side of the transport means (2) covered with yarn (3), characterised in that the separating elements are disposed only on the side of the transport means (2) covered by the yarn and out of contact with the transport means (2) to passively follow in contact with and yield to the yarns (3), the separating elements comprise at least one of a flexible material (6), a flexible loop (7), a rotatable roller (10) having a surface made from a resiliently compressible material and an upper band (11) having a surface made from a resiliently compressible material, and wherein a curve is formed in the flexible material or the flexible material already has a curved form so that the separating element lies flat on a free end flat on the yarn and said separating elements (6, 7, 10, 11) having a predetermined bending rigidity to apply a predetermined surface load onto the yarn (3) lying on the transport means (2) less than 0.005 $kg*cm^{-2}$ selected to effectively maintain uniformity of thermal treatment of the yarn (3) within the device (1) without causing damage to the yarn (3).

3. Device according to claim 2, characterised in that a loading element (8) is arranged inside the flexible loop (7).

4. Device according to claim 2, characterised in that the yarn-contacting side of the flexible material (6) has low-friction properties.

5. Device according to claim 2, characterised in that at least two separating elements (6, 7, 10, 11) are provided respectively which are arranged behind one another.

6. Device according to claim 2, characterised in that the separating elements can be used in a multipoint installation in particular for twisting and cabling machines.

* * * * *